United States Patent [19]

Martin

[11] 4,428,531

[45] Jan. 31, 1984

[54] METHOD OF PRODUCING A FUEL INJECTOR

[75] Inventor: Barrie J. Martin, Shenfield, England

[73] Assignee: Eaton Corporation, Cleveland, Ohio

[21] Appl. No.: 179,425

[22] Filed: Aug. 19, 1980

[30] Foreign Application Priority Data

Sep. 11, 1979 [GB] United Kingdom ..... 7931505

[51] Int. Cl.[3] ..... B05B 17/06

[52] U.S. Cl. ..... 239/102

[58] Field of Search ..... 239/600, 102; 29/157 C, 29/157 R; 228/101, 174

[56] References Cited

U.S. PATENT DOCUMENTS 4,166,577 9/1979 Elwell ..... 239/102

4,349,947 9/1982 Rood ..... 29/157 C

*Primary Examiner*—John J. Love

*Attorney, Agent, or Firm*—C. H. Grace; R. A. Johnston

[57] ABSTRACT

A method of producing a fuel injector as herein defined, which method comprises securing the housing to an elongate member and securing the elongate member to the end of the injector remote from the orifice.

4 Claims, 1 Drawing Figure

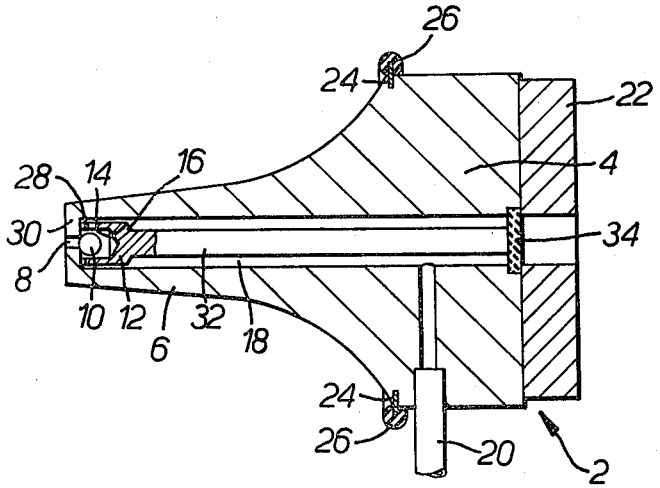
26
24
22
4
28
14
16
30
34
8
10
12
6
32
18
24
26
20
2

METHOD OF PRODUCING A FUEL INJECTOR

This invention relates to a method of producing a fuel injector.

Injectors for injecting fuel for an engine are well known. As used herein, a fuel injector is one comprising a nozzle, a fuel injection orifice in the nozzle, valve obturator means for closing the orifice, vibratory means for vibrating the nozzle to cause the valve obturator means to move away from the orifice to allow fuel to be injected, and a housing for the valve obturator means.

Hitherto, the production of the fuel injector has required brazing or welding at the tip of the injector adjacent the orifice. This injector tip is arranged to be at an anti-node when the injector is being vibrated because the injector tip is required to be vibrated with maximum amplitude. It thus follows that the injector tip is a place of maximum sensitivity and this is not logically a good place to conduct brazing or welding because the brazing or welding may upset the required maximum amplitude of vibration.

The present invention aims to overcome this problem and it does so by effecting appropriate connections at the end of the injector remote from the orifice.

Accordingly, this invention provides a method of producing a fuel injector as herein defined, which method comprises securing the housing to an elongate member and securing the elongate member to the end of the injector remote from the orifice.

Preferably, the elongate member is a rod. The housing may be separately secured to the elongate member or it may be formed as part of the elongate member. The elongate member is preferably secured to the end of the injector remote from the orifice by brazing, welding or adhesives.

The housing may abut, or almost abut, a transverse end face of the nozzle, the tranverse end face containing the orifice. Alternatively, the housing may be positioned remote from the orifice thereby allowing fuel to enter the housing. When the housing almost abuts the transverse face, it will usually be provided with fuel slots at its end adjacent the transverse face, the fuel slots allowing fuel to enter the housing.

An embodiment of the invention will now be described solely by way of example and with reference to the accompanying drawing which is a longitudinal cross section through an injector produced in accordance with the present invention.

Referring to the drawing, there is shown an injector 2 comprising a body portion 4 and a nozzle 6. The nozzle 6 is provided with an orifice 8 which is adapted to be closed by valve obturator means in the form of a ball 10. The ball 10 operates in a housing 12 having a rear face 14 to which the ball 10 tends to travel when it moves away from the orifice 8. The housing 12 is provided with an aperture 16 through which fuel passes from a passageway 18 and forces the ball 10 back towards the orifice 8 for speedy shut-off of the fuel injection through the orifice 8. The fuel is provided in the passageway 18 from a fuel pipe 20.

A piezoelectric crystal device 22 is secured to the body portion 4 of the nozzle 6. When this device 22 is electrically activated, the nozzle 6 and especially its tip containing the orifice 8 is caused to vibrate and the ball 10 is moved away from the orifice 8 as mentioned above. The ball 10 is arranged to be at a vibration anti-node in order to ensure that the ball 10 is subjected to the maximum possible vibrations.

The body portion 4 is provided with a flange 24 which mounts an O-ring seal 26. The seal 26 enables the nozzle 2 to be secured to a surrounding mounting arrangement (not shown) so that, for example, fuel can be injected through the orifice 8 into a duct leading to an engine. The seal 26 is arranged to be at a vibration node which is a position of minimum vibration in order to minimise on the loss of energy from the injector 2 to the mounting arrangement. The use of the seal 26 is also active in helping to reduce loss of energy.

The housing 12 is provided with a plurality of slots 28 through which fuel passes to the interior of the housing 12. The housing 12 is maintained in a position very close to but not touching a transverse face 30 of the nozzle 6 by being connected to an elongate member in the form of a rod 32. The rod 32 is secured to the body portion 4 at position 34 by brazing, welding or adhesives. This position 34 is arranged to be at a vibration node which will be at a position of minimum amplitude and therefore the actual brazing, welding or adhesive will not unduly affect the performance of the injector 2 by slowing down or altering the frequency of vibration of the tip of the injector 2.

It is to be appreciated that the embodiment of the invention described above with reference to the accompanying drawing has been given by way of example only and that modifications may be effected.

I claim:

1. The method of producing an ultrasonic nozzle comprising the steps of:

(a) providing a nozzle body having an inner passageway terminating in a valved orifice at one end thereof and securing to the other end means operable for generating ultrasonic vibrations;

(b) disposing a valve housing within said passageway and positioning said housing over said orifice valve and spacing said housing from said orifice;

(c) disposing an elongated member in said housing and securing said housing to said member at one end thereof; and, (d) securing the opposite end of said elongated member to said body at a location remote from said valved orifice.

2. The method defined in claim 1, wherein the step of disposing said housing in said passageway includes the step of providing an elongated member with one end received over said orifice valve and securing the opposite end thereof to said nozzle body.

3. The method defined in claim 1 wherein the step of positioning said housing includes the step of forming an elongated member having a cavity in one end and disposing said cavity over said orifice valve.

4. The method defined in claim 1 further including the step of forming the valve housing and elongate member integrally.

* * * * *